US005740849A

United States Patent [19]

Tashman

[11] Patent Number: 5,740,849

[45] Date of Patent: Apr. 21, 1998

[54] MULTIPLE MODE LATCH FOR SLIDING SCREEN DOOR SYSTEM

[75] Inventor: Fred Tashman, Scottsdale, Ariz.

[73] Assignee: Tashco Industries, Inc., Gilbert, Ariz.

[21] Appl. No.: 689,375

[22] Filed: Aug. 8, 1996

[51] Int. Cl.[6] ..... A47H 1/00

[52] U.S. Cl. ..... 160/102; 160/96; 160/220; 49/449; 292/DIG. 46

[58] Field of Search ..... 160/102, 90, 96, 160/200, 202, 220; 49/449, 460; 292/145, DIG. 46

[56] References Cited

U.S. PATENT DOCUMENTS

| | | | |
|---|---|---|---|
| 2,267,026 | 12/1941 | Haczka . | |
| 3,078,524 | 2/1963 | Minick | 49/449 |
| 3,266,832 | 8/1966 | Johnston | 292/DIG. 46 X |
| 3,837,692 | 9/1974 | Ayers . | |
| 3,848,908 | 11/1974 | Rich . | |
| 3,938,577 | 2/1976 | Richards . | |
| 4,061,370 | 12/1977 | Hauber | 292/DIG. 46 X |
| 4,079,771 | 3/1978 | Theiss . | |
| 4,202,136 | 5/1980 | Riegelman . | |
| 4,606,145 | 8/1986 | Trombettas . | |
| 4,678,213 | 7/1987 | Brasuell . | |
| 4,838,332 | 6/1989 | Mlenek . | |
| 4,973,091 | 11/1990 | Paulson et al. | 292/DIG. 46 X |
| 5,172,520 | 12/1992 | Hostetler et al. | 49/449 |
| 5,224,297 | 7/1993 | Watkins | 49/449 |
| 5,421,627 | 6/1995 | Yane | 292/DIG. 46 X |
| 5,511,833 | 4/1996 | Tashman . | |

*Primary Examiner*—Kenneth J. Dorner
*Assistant Examiner*—Bruce A. Lev
*Attorney, Agent, or Firm*—LaValle D. Ptak

[57] ABSTRACT

A closure system for a sliding main door and a sliding screen door system of the type typically used in houses and some commercial buildings operates to permit three modes of operation of the sliding screen door and the sliding main door relative to one another. In a first mode of operation handles on the doors freely pass by one another and the two doors may be operated completely independently of one another. The handle on the sliding screen door is capable of movement to different vertical positions; and in another position, cooperating surfaces on the two handles cause the sliding screen door always to be closed when the main door is closed. When the main door is opened, however, the sliding screen door in this mode is capable of movement back and forth independently of the main door to the extent of the opening of the sliding main door. A third mode of operation is effected by a third position of the handle on the sliding screen door moved from the second position to the third position when the cooperating surfaces of the first and second handle members are engaged. In this mode, the two doors open and close together when an operator moves either of them between the open and closed positions thereof.

16 Claims, 1 Drawing Sheet

MULTIPLE MODE LATCH FOR SLIDING SCREEN DOOR SYSTEM

BACKGROUND

Sliding glass doors are widely used in home construction and some commercial installations. Typically, such sliding doors include a main door which has a glass pane or double glass pane in it. The main door is mounted in a vertical plane on a track; and rollers at the bottom of the door facilitate a back and forth movement of the door. For most installations, a second sliding screen door is mounted on the outside of the main sliding door in a vertical plane spaced from the plane of the main door and parallel to it for back and forth movement across the opening of the main sliding door.

Generally, the main sliding door and the sliding screen door are independently movable and are independently locked or latched relative to one another. The result is that if both doors are closed and a person desires to exit through the door opening, the main sliding door first must be opened. Then the screen sliding door is opened. To move the screen across the opening, it then independently is moved to its closed position.

If the screen is left open and a person walks through the main sliding door and then closes the main sliding door, it is possible for the screen to be located either at its fully open position or a position partially across the sliding door and the fixed window located adjacent the main sliding door. This results in some visual blockage of the view through the window portions, because the vertical end or edge of the sliding screen door is out of alignment with the corresponding vertical edges of the fixed window and the main sliding door.

Typically, the latch or lock on the sliding screen door is a relatively weak mortise latch concealed in a hollow of the style extrusion and connected to the catch by a movable hook. Damage may occur to the catch or opening if the door is forcefully closed when the latching hook is in its "latched" position prior to full closure of the door. This may cause a breaking or bending of the catch opening, and frequently results in failure of the latching mechanism. A similar problem exists for the latch of the main sliding door when this type of latch is used.

A different type of closure latch, which is used both with sliding glass doors and sliding screen doors associated with such doors, is what is called a "clam surface" latch or lock. Clam surface latches generally are preferable to mortise-type latches, but still provide relatively weak latching or locking of either a sliding screen door or the main sliding door.

Whichever type of latch is used, however, the sliding screen door always is independently movable with respect to the main sliding door. At some times of the year, such as winter, it is desirable to have the two doors move together, since the screen rarely is used independently of the main sliding door when outside temperatures are very low, or during inclement weather. When the two doors must be independently operated, however the sliding screen door either is left in its fully open position (located over the fixed window adjacent the main sliding door) or a double operation of the two doors is required by persons desiring to enter or exit the building in which the doors are located.

An effective improved latching mechanism for sliding doors is disclosed in the U.S. Pat. No. 5,511,833 to Tashman. The latching mechanism used in the Tashman patent is a combined handle and latching mechanism, which operates between first and second vertical positions of the handle to move the handle toward and away from the frame of the sliding door. An elongated flange on the handle overlies an outwardly extending flange adjacent the frame when the door is closed. When the handle is moved upwardly, the handle moves outwardly away from the frame adjacent the door release the engagement of the flanges.

Efforts to provide a door structure where a main door and a screen door are opened and closed together in one mode of operation, and where the screen door may be independently opened and closed when the main door is in its open position, have been addressed in the U.S. Pat. No. 3,938,577 to Richards. This patent is directed to an overhead one-piece garage door which pivots from a vertical or closed position to a horizontal or open position, with the bottom edge of the door paralleling the upper edge of the garage opening. In one mode of operation, a screen is moved on rollers in channels attached to the main door to a position where the screen overlies the garage door on the inside thereof when the garage door is in either its open or closed position. In this mode of operation, the two doors act together in unity; and the garage opening is closed or opened in a standard manner by operating the main door.

When the garage door of the Richards patent, however, is in its open position, the screen door may be moved independently into the garage opening by release of a latch on the screen mechanism to permit it to be lowered or closed across the garage opening. Thus, this patent has two different modes of operation.

The U.S. Pat. No. 4,079,771 to Theiss discloses a projection on the upper edge of a sliding main door used to open and close draperies along with the opening and closing of the sliding door. This patent, however, does not disclose any type of interrelationship between a sliding screen door and the main sliding door.

The U.S. Pat. No. 4,838,332 to Mlenek discloses a separate insert to be placed in the door opening of a sliding door to provide a vertically hinged or swinging screen door for the opening. This is used in place of a sliding screen door; so that the screen door mechanism always is in place across the opening.

It is desirable to provide a sliding door and sliding screen door system capable of operating in any one of three different modes, namely where the two doors are operated fully independently of one another, where the closure of the main door always closes and secures the sliding screen door but where opening of the main door permits independent opening and closing of the sliding screen door, and finally, where the main door and sliding screen door are latched together to be opened and closed together as a unit.

SUMMARY OF THE INVENTION

It is an object of this invention to provide an improved sliding screen door system.

It is another object of this invention to provide an improved sliding screen door system capable of operating in different modes of operation.

It is an additional object of this invention to provide an improved sliding screen door system in which locking of the screen door is effected by the locking and latching of the main sliding door.

It is a further object of this invention to provide an improved sliding door system capable of operating in three distinct modes of operation including fully independent operation of the sliding main door and the sliding screen door, fully dependent operation.

In accordance with a preferred embodiment of this invention, a closure system is designed for a sliding main door and a sliding screen door in which the sliding main door and the sliding screen door move in adjacent spaced parallel planes. A pull handle member is mounted on the exterior of the sliding vent of the sliding door. This handle member is located in the space between the main sliding door and the adjacent sliding screen door. A second handle member is mounted on the sliding screen door for movement in a direction perpendicular to the direction of the movement of the sliding screen door. This second handle member is designed to be movable to at least first and second different positions. In the first position, the two doors are capable of fully independent operation with respect to one another. Cooperating surfaces are provided on the first and second handle members for engagement of the second handle member by the first when the second handle member is in the second position thereof, and when the main sliding door is moved in a first direction. These surfaces, however, are not engaged when the main sliding door is moved in a second, opposite direction; so that the sliding screen door may be moved back and forth between a closed and an open position independently of the main sliding door when the main sliding door is in the open position thereof.

DETAILED DESCRIPTION

Figure 1:
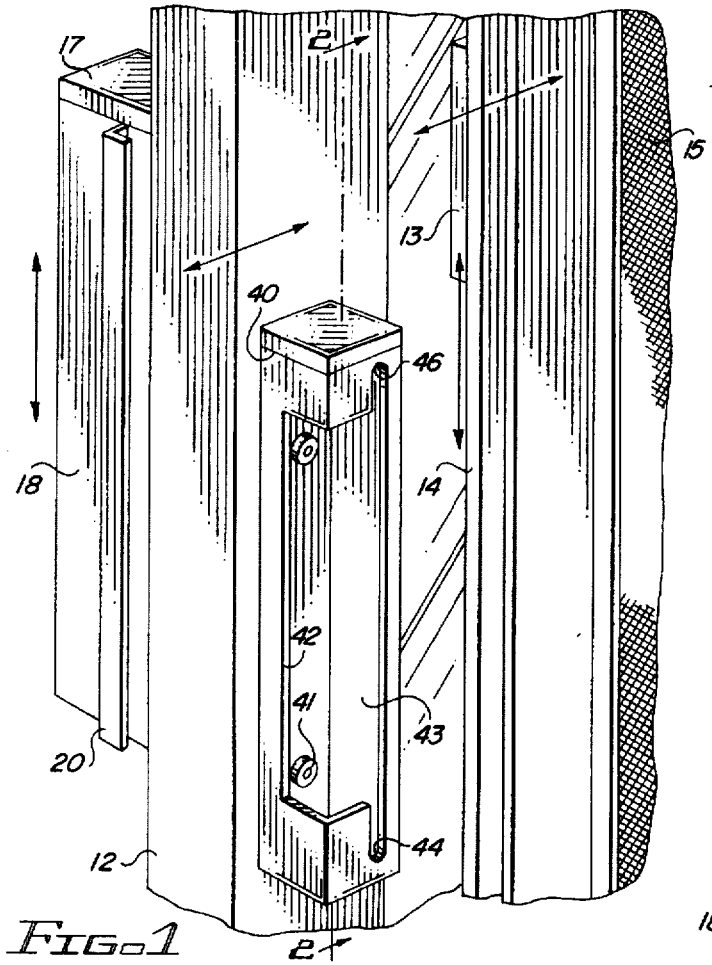
FIG. 1 is a partially cut away perspective view of preferred embodiment of the invention.

Reference now should be made to the drawings, in which the same reference numbers are used throughout the different figures to designate the same components. FIG. 1 is a rear perspective view of a portion of the forward edges of a main sliding door and a screen sliding door mounted in adjacent, spaced, parallel, vertical planes. The main sliding door 12 has a handle and latching mechanism 17, 18 and 20 located on the inside thereof. This handle and latching mechanism preferably is of the type disclosed in the U.S. Pat. No. 5,511,833 to Tashman, the disclosure of which is incorporated in full herein by reference. The latching and handle mechanism of Tashman U.S. Pat. No. 5,511,833 preferably is used in conjunction with the embodiment shown in FIG. 1; but it should be noted that standard clam surface latching mechanisms or mortise-type latching mechanisms for the main door 12 may be used in place of the handle and latching mechanism 17, 18 and 20 if desired.

Figure 2:
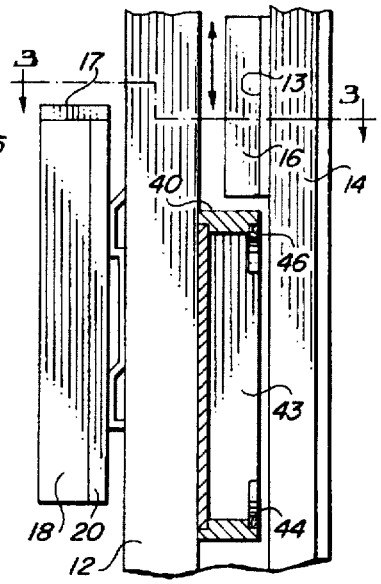
FIG. 2 is a cross section taken along the line 2—2 of FIG. 1.
Figure 4:
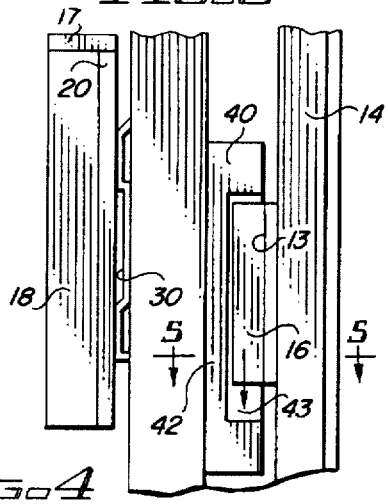
FIG. 4 is a cross-sectional view taken along the same line as FIG. 2—2 but showing a different mode of operation.
Figure 3:
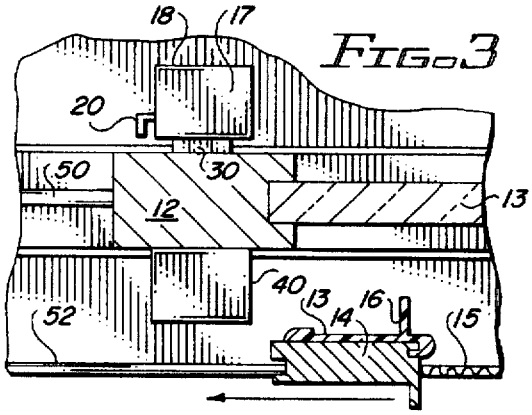
FIG. 3 is a cross-sectional view taken along the line 3—3 of FIG. 2.
Figure 6:
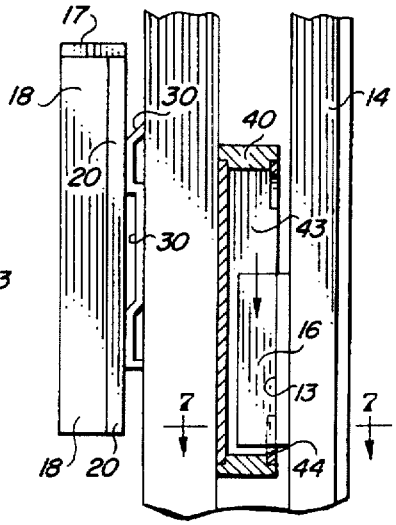
FIG. 6 is a cross-sectional view similar to the view of FIG. 2 showing a third mode of operation.
Figure 5:
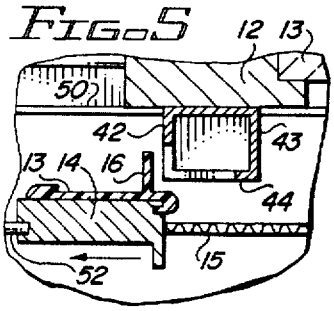
FIG. 5 is a cross-sectional view taken along the line 5—5 of FIG. 4.

Since the doors in which the handles and latching mechanisms illustrated in FIG. 1 through 7 are otherwise standard, these doors have not been shown in full in any of the figures of the drawing, since the manner in which they operate is well known. It is sufficient to note that the left-hand edge of the main sliding door 12, as shown in FIGS. 1, 3, 5 and 7, is the edge which is moved between open and closed positions across an opening of a dwelling or other building. This main sliding door has a glass pane 13 (shown most clearly in FIG. 3) and other portions of the frame of the sliding door, which may include rollers on the bottom for engagement (at the bottom) for example, on a rib 50, as shown in FIGS. 3, 5 and 6.

A sliding screen door also has a frame portion 14 on its lock stile; and the sliding screen door similarly moves on rollers (not shown) on its bottom, which engage a rib 52 (shown most clearly in FIG. 3) to permit the two doors to be moved back and forth in parallel with one another across the door opening. Typically, the screen sliding door comprising the frame 14 and a screen 15 is of considerably lighter construction than the main door, since the weight of the glass panel 13 is considerably greater than the weight of the material used to form the screen 15.

As illustrated most clearly in FIG. 1, a handle 40 on the outside side of the main sliding door 12 is located in the space between the sliding door vent and the sliding screen. The clearance for this handle is illustrated in all of the other figures; and it can be seen that it does not interfere with the frame 14 of the sliding screen door. The handle 40 preferably is secured by means of fasteners 41 extending through the frame 12 of the main sliding door and a base 30 (see FIGS. 2, 4 and 6) on which the inside handle 17, 18 and 20 is mounted. The manner of mounting the outside handle 40 to the base member 30 is disclosed in detail in the above mentioned Tashman U.S. Pat. No. 5,511,833. Ideally, the handle 40 may not be removed from the frame 12 from the outside but only from the inside of the door. Consequently, threaded openings 41 are engaged by bolts which extend from the opposite side of the door shown in FIG. 1 to secure all of the parts together.

As shown most clearly in FIG. 1, the rear surface of the handle 40 is secured to the outside of the door frame 12. This handle is cut out on the forward edge or side thereof at 42, and on the front surface to the rear edge or side 43, with a pair of vertical notches 44 and 46 located on the front surface at the rear edge 43.

As shown most clearly in FIGS. 2 and 3, a vertically sliding handle 13 is attached to the leading edge of the screen door 14. The handle 13 includes a finger-like projection extending into an elongated vertical extrusion in the rear portion of the front frame 14 (shown most clearly in FIGS. 3, 5 and 7) to permit the handle 13 to be moved to various vertical positions along the frame 14. A flange 16 is located along the full length of the handle 13 and extends partially into the space between the vertical frame 12 of the main sliding door and the vertical front frame 14 of the sliding screen door. The extent to which the flange 16 extends into this space between the two doors is shown most clearly in FIG. 2.

The system which is disclosed is capable of operating in three different modes of operation. The first of these modes is shown with the handle 13/16 on the sliding screen door moved to the vertical position shown in FIGS. 2 and 3. In this mode, the flange 16 is located either fully above the top of the handle 40 or, in the alternative, it may be located fully below the bottom of the member 40. This alternative position has not been shown, since the operation of the two doors is identical whether the handle member 13/16 is located above or below the handle member 40, which is attached in a fixed position to the frame 12 of the main sliding door.

In the mode of operation illustrated in FIGS. 2 and 3, the two doors operate fully independently of one another. This is illustrated in the top cross-sectional view shown in FIG. 3 where the flange 16 passes either fully above or fully below the handle 40, but no contact between the two handles is made as the two doors are moved back and forth relative to one another. When the system is operated in this mode, the operation is the standard operation of sliding patio door and screen systems of the prior art.

A second mode of operation is illustrated in FIGS. 4 and 5. In this mode of operation, the handle 13/16 on the forward frame 14 of the sliding screen door is slid downwardly from the position shown in FIG. 2 to be centered in or located within the cut out portion 42 of the handle 40. As is most readily apparent from an examination of FIG. 5, whenever the main sliding door frame 12 is moved to the left, as illustrated in FIGS. 1 and 5, the rear edge 43 of the handle 40 engages the flange 16 of the handle on the screen door 14; so that the two doors move together in the direction of the arrow shown in FIG. 5. Whenever the main sliding door 12 is opened (moved to the right in FIG. 5), the surface 43 moves away from the flange 16 and the screen door remains in whatever position to which it had been moved previously by the main door frame 12 in the left-hand direction. Thus, the screen 14 may be opened and closed independently in the same manner as in the first mode of operation but only to the extent of engagement of the flange 16 with the surface 43. If the main sliding door is not in its fully opened position, movement of the screen 14 to the right (as viewed in FIGS. 1 and 5) causes engagement of the flange 16 with the surface 43. Continued pressure on the screen 14 causes both doors to move to the right until the fully opened position of the sliding screen door is reached. In this mode of operation, whenever the sliding screen door, however, is moved to its closed position it forces the closure of the sliding screen door because of the engagement of the surface 43 with the flange 16. Consequently, whenever the sliding main door 12 is locked from the inside, the screen 14 also is locked, since it is securely held in place by means of the engagement of the surface 43 of the handle 40 with the flange 16.

Figure 7:
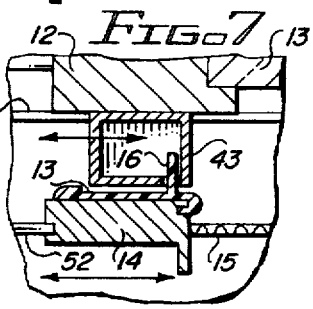
FIG. 7 is a cross-sectional view taken along the line 7—7 of FIG. 6.

The third mode of operation is illustrated in FIGS. 6 and 7. In this mode, the handle 13/16 on the sliding screen door 14 is moved downwardly when the flange 16 is engaged by the surface 43 to cause the lower edge of the flange 16 to be seated into the notch 44 located in the front surface of the handle 40 adjacent the recur edge 43. A similar latching or engagement could be made with the two parts in the relative position shown in FIG. 7 by moving the handle 13/16 upwardly to engage the upper edge of the flange 16 in the notch 46, if desired. The operation of the system is the same whether the notch 44 or the notch 46 is engaged. It is readily apparent from an examination of FIGS. 6 and 7, that when the two handles are in the relative position which is shown, both the main sliding door 12 and the sliding screen door 14 move back and forth together as a single unit whether they are operated by moving either of the two doors. Whenever the inside or main door 12 is latched or locked in place, the screen 14 cannot be moved, since its handle is secured mechanically to the outside handle 40 of the main door and the surface 43 prevents movement to the right (as viewed in FIG. 7) of the flange 16 on the handle mounted on the screen door 14.

It should be noted that all of the three different modes of operation which have been described above are accomplished by direct mechanical links between the handle 40 on the outside of the main or inside sliding door and a vertically sliding handle 13/16 on the inside of the outer screen door. The materials out of which the various components are made typically are high-impact plastic or extruded or molded aluminum. These are standard materials used in the construction industry for manufacturing sliding doors and screen door combinations. It also should be noted that the particular configurations of the different parts also may be varied to perform substantially the same function, in substantially the same way, to achieve substantially the same result by those skilled in the art, without departing from the true scope of the invention as defined in the appended claims.

What is claimed is:

1. The combination of a closure system and a sliding main door and sliding screen door in which said sliding main door and said sliding screen door are mounted to move in first and second opposite directions in adjacent, parallel, spaced, vertical planes, said combination including:

a sliding main door;

a sliding screen door adjacent said sliding main door in a parallel spaced plane to the plane of said sliding main door;

a first handle member mounted on the sliding main door and located in the space between said sliding main door and said adjacent sliding screen door when said doors are mounted for movement in said first and second opposite directions in spaced, parallel, vertical planes;

a second handle member mounted on said sliding screen door for movement on said sliding screen door in a direction perpendicular to the direction of movement of said sliding screen door in said first and second opposite directions to at least first and second different positions;

cooperating surfaces on said first and second handle members for engagement of said second handle member by said first handle member, with said second handle member in said first position thereof when said sliding main door is moved in said first direction, but not engaged when said sliding main door is moved in said second opposite direction; and said sliding main door and said sliding screen door capable of fully independent movement with said second handle member in said second position.

2. The combination according to claim 1 wherein said cooperating surfaces on said first and second handle members are flat surfaces and said first direction comprises the direction of movement of said sliding main door toward a closed position thereof.

3. The combination according to claim 2 wherein said first position of said second handle member is located to permit said sliding screen door to move freely between open and closed positions thereof in an amount determined by the location of said sliding main door away from the closed position thereof.

4. The combination according to claim 3 further including mechanical interlock members on said first and second handle members for locking said first and second handle members together in a third position of said second handle member, so that said sliding main door and said sliding screen door move together in said first and second opposite directions between a closed position thereof and open positions thereof.

5. The combination according to claim 4 wherein said mechanical interlock member comprises a notch on one of said first and second handle members and an extension on the other of said first and second handle members for movement into said notch with said second handle member moved to said third position thereof.

6. The combination according to claim 5 wherein said notch is formed in said first handle member and said extension comprises a flange on said second handle member extendable into said notch with said second handle member in said third position thereof.

7. The combination according to claim 1 further including mechanical interlock members on said first and second handle members for locking said first and second handle members together in a third position of said second handle member, so that said sliding main door and said sliding screen door move together in said first and second opposite directions between a closed position thereof and open positions thereof.

8. The combination according to claim 7 wherein said mechanical interlock member comprises a notch on one of said first and second handle members and an extension on the other of said first and second handle members for movement into said notch with said second handle member moved to said third position thereof.

9. The combination according to claim 1 wherein said first position of said second handle member is located to permit said sliding screen door to move freely between open and closed positions thereof in an amount determined by the location of said sliding main door away from the closed position thereof.

10. The combination of a closure system and a sliding main door and a sliding screen door in which said sliding main door and said sliding screen door move between closed and open positions in adjacent, parallel, spaced vertical planes, said combination including:

a sliding main door;

a sliding screen door adjacent said sliding main door in a parallel spaced plane to the plane of said sliding main door;

a first handle member mounted on said sliding main door in a fixed position and located in the space between said sliding main door and said adjacent sliding screen door when said sliding main door and said sliding screen door are mounted for movement in first and second opposite directions in spaced parallel vertical planes;

a second handle member on said sliding screen door mounted for movement on said sliding screen door in a direction perpendicular to the direction of movement of said sliding screen door and capable of positioning to at least first, second and third different positions; and direct mechanical coupling between said second handle member and said first handle member in said second and third positions of said second handle member to cause said second handle member in the second position thereof to be engaged by said first handle member when said sliding main door is moved in said first direction, but not engaged when said sliding main door is moved in said second opposite direction, and said first and second handle members being mechanically linked together in the third position of said second handle member to cause said sliding main door and said sliding screen door to be moved together in both of said first and second directions with said second handle member in said third position thereof.

11. The combination according to claim 10 wherein said, said first handle member has upper and lower ends, and said first, second and third positions of said second handle member constitute first, second and third vertically spaced positions of said second handle member on said sliding screen door, with said first position locating said second handle member free of engagement with said first handle member, said second position of said second handle member locating said second handle member for engagement by said first handle member only when said sliding main door is moved in said first direction.

12. The combination according to claim 11 wherein said first handle member comprises a substantially elongated hollow rectangular member with a rear surface adapted for mounting on said main sliding door and a front surface cut away a predetermined distance from first and second ends thereof, and a first side cut away in alignment with the cut away of said front surface, and with vertical notches formed adjacent a second side thereof in said front surface extending vertically parallel to said second side.

13. The combination according to claim 12 wherein the second position of said second handle member aligns said second handle member with the cut away portion of the first side of said first handle member and the third position of said second handle member is effected to move the cooperating surface of said second handle member into one of said notches in said first handle member.

14. The combination according to claim 10 wherein said first handle member comprises a substantially elongated hollow rectangular member with a rear surface adapted for mounting on said main sliding door and a front surface cut away a predetermined distance from first and second ends thereof, and a first side cut away in alignment with the cut away of said front surface, and with vertical notches formed adjacent a second side thereof in said front surface extending vertically parallel to said second side.

15. The combination according to claim 14 wherein the second position of said second handle member aligns said second handle member with the cut away portion of the first side of said first handle member and the third position of said second handle member is effected to move the cooperating surface of said second handle member into one of said notches in said first handle member.

16. The combination according to claim 10 wherein said first position of said second handle member is located to permit said sliding screen door to move freely in said first and second opposite directions between open and closed positions thereof in an amount determined by the location of said sliding main door away from the closed position thereof.

* * * * *